United States Patent [19]

Ferris et al.

[11] Patent Number: 4,534,566

[45] Date of Patent: Aug. 13, 1985

[54] BOARD GAME WITH REVERSIBLE SECONDARY PIECES

[75] Inventors: Michael J. Ferris; Paul H. Wise, both of Chicago; Jeffrey D. Breslow, Highland Park, all of Ill.

[73] Assignee: Marvin Glass & Associates, Chicago, Ill.

[21] Appl. No.: 638,531

[22] Filed: Aug. 6, 1984

Related U.S. Application Data

[63] Continuation of Ser. No. 426,368, Sep. 29, 1982, abandoned.

[51] Int. Cl.[3] ..... A63F 3/00

[52] U.S. Cl. ..... 273/248; 273/288; 273/291

[58] Field of Search ..... 273/146, 260, 243

[56] References Cited

U.S. PATENT DOCUMENTS

| | | | |
|---|---|---|---|
| 1,631,505 | 6/1927 | Samis | 273/146 X |
| 1,673,705 | 6/1928 | Pesnel | 273/287 |
| 2,722,424 | 11/1955 | Hum | 273/291 X |
| 3,130,972 | 4/1964 | Schwarzlander | 273/258 |
| 3,595,580 | 7/1971 | Bucko | 273/260 |
| 3,902,725 | 9/1975 | Hersey | 273/290 X |
| 3,908,998 | 9/1935 | Fong | 273/258 |
| 3,912,273 | 10/1975 | Barlow | 273/287 X |
| 3,963,243 | 6/1976 | Contento | 273/146 X |
| 4,124,213 | 11/1978 | Kaplowitz | 273/248 |
| 4,211,420 | 7/1980 | Quiroz | 273/260 |
| 4,364,568 | 12/1982 | Tracy | 273/242 |

OTHER PUBLICATIONS

"Chinese Chess", Games of the World, p. 71, ©1975.

*Primary Examiner*—Richard C. Pinkham
*Assistant Examiner*—Scott L. Brown

[57] ABSTRACT

A board game includes a game board with a pattern of playing positions, defined on a playing surface, conveniently arranged in a gridwork pattern. A first set of playing pieces, positionable on the various playing positions defined on the playing surface, are arranged initially equally on two opposite sides of the game board. The two separated groups of playing pieces are movable across the game board towards one another, the object of the game being for each of the players to get his or her assigned group of playing pieces across the board to the other side before the other player. The second set of playing pieces are positionable on the various playing positions defined on the playing surface and are movable transversely across the game board in order to help or interfere with the progress of the first set of playing pieces across the game board. A chance selection device governs the movements of both the first and second sets of playing pieces.

18 Claims, 6 Drawing Figures

10
12
14
16
18a
18b
24
26
28
28A
28B
30
32
34
36
38
40
42
44
46
48
54
TURN LEFT
3
2

28
30
32
18b 56
18a
54

28
30
16

16
41
50
18a
52

58
60
24
ALL
HOP
OVER

BOARD GAME WITH REVERSIBLE SECONDARY PIECES

This is a continuation of co-pending application Ser. No. 426,368 filed Sept. 29, 1982, and since abandoned.

BACKGROUND OF THE INVENTION

1. Field of the Invention

This invention relates generally to board games and particularly to board games of the type which implement in an ingenious fashion a game comparable to the action enjoyed by well-known video games.

2. Description of the Background Art

A very immense variety of board games are known in the art. Generally these games involve a pattern of playing positions on a playing surface that must be traversed by one or more players, the first player to completely traverse the pattern of playing positions being the winner. Successful board games have been capable of providing extremely enjoyable interplay, partly because of the fanciful scenario set up by these games and partly due to the competition set up between players.

However, currently electronic video arcade type of games are enjoying considerable entertainment attention. These games are capable of extremely realistic and exciting visual and audio effects. Usually instead of requiring direct competition between players, each video game player competes against the machine and the player who competes most successfully against the machine is the winner. Thus, to some degree, electronic video games have compromised the interplay possible with board game to achieve a machine interactive format. In addition, the electronic video games require a considerable investment either in terms of hardware or in terms of coins used to play coin operated video games. While for many players this investment in capital is considered extremely worthwhile, it would be highly desirable to provide a game that implements exciting interaction comparable to that experienced with the video games in the less expensive format.

SUMMARY OF THE INVENTION

It is a primary object of the present invention to provide a board game which is capable of implementing player interaction and entertainment comparable or superior to that enjoyed by electronic video games.

These and other objects of the present invention are achieved by a board game including a game board having a playing surface. A variety of playing positions are defined on the playing surface. A first set of playing pieces are positionable on the playing surface and are movable over the playing surface in a first direction. A second set of playing pieces positionable on the playing surface are movable over the playing surface in a second direction, the second direction being generally transverse to the first direction. The chance selection means determines the extent of movement of the various playing pieces.

DESCRIPTION OF THE PREFERRED EMBODIMENT

Figure 1:
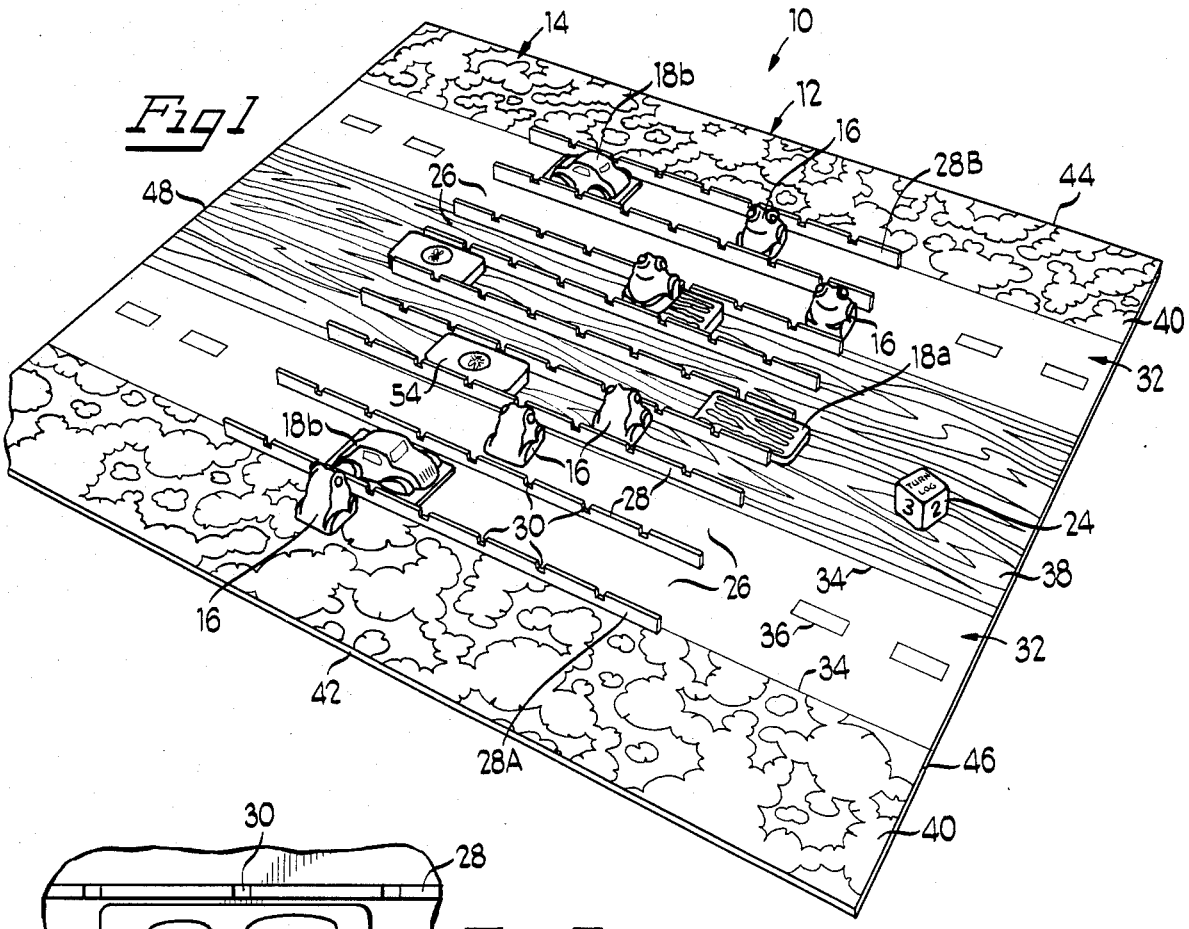
FIG. 1 is a partial, perspective view of one embodiment of the present invention in the course of play.
Figure 2:
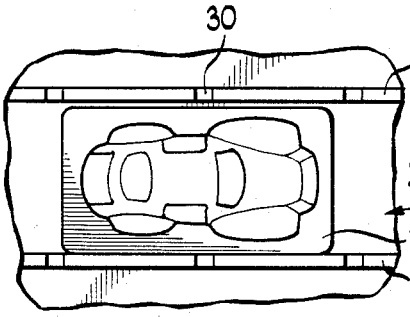
FIG. 2 is an enlarged, partial, top plan view showing a portion of the embodiment illustrated in FIG. 1 and particularly showing one of the playing pieces of the second set.

Referring to the drawing wherein like reference characters are used for like parts throughout the several views, the board game 10, shown in FIG. 1, includes a game board 12 with a playing surface 14 defined thereon. The first set of playing pieces 16, illustrated in the form of frogs, are positionable on the playing surface together with a second set of playing pieces 18 conveniently including the log playing pieces 18*a* and the car playing pieces 18*b*. The chance selection device 24, conveniently a single die, is provided for controlling the movement of the playing pieces 16 and 18 along the playing surface 14.

A gridwork of playing positions 26 is defined on the playing surface 14 by a plurality of generally parallel members 28, each including a plurality of regularly spaced indicators 30, illustrated in the form of notches, to define the vertical boundary between adjacent playing positions 26. Thus the horizontal boundary of the various playing positions is defined by the position of the various members 28 while the vertical boundary is defined by aligned indicators 30 from one adjacent member 28 to the next. In addition, a variety of indicia 32–40 are provided on the playing surface 14 which also indicate the location of the various playing positions 26. Specifically, a pair of road indicia 32 are provided, separated by river indicia 38, the road indicia 32 including a pair of spaced lines 34 and an intermediate center line 36 which coincide with the location of certain of the members 28. Swamp indicia 40 are located outwardly of the road indicia 32.

The first set of playing pieces 16 are made up of a plurality of playing pieces, conveniently in the shape of frogs that are supported on a flat lower surface 41. The playing pieces of the first set 16 are initially positioned along the members 28A and 28B, located over the swamp indicia 40. The first set of playing pieces 16 may initially be located anywhere along the length of the members 28A or 28B so they may be moved onto a playing position 26 adjacent thereto. Advantageously the playing pieces of the first set 16 move vertically across the playing surface between the game board 12 edges 42 and 44. Thus the object of the game is for each player to traverse a plurality of playing pieces of the first set 16 from one swamp indicia 40 to the opposite swamp indicia 40. Initially each player positions his or her playing pieces 16 on opposite swamp indicia 40 and thereafter the playing pieces 16 are moved toward the swamp indicia 40 from which the opposing player begins, in order to win the game.

Figure 3:
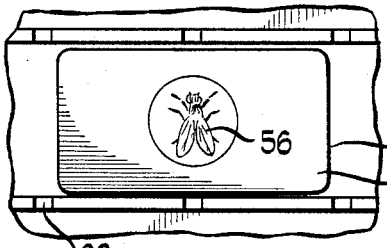
FIG. 3 is a partial, enlarged, top plan view of a portion of the embodiment shown in FIG. 1, particularly illustrating one of the playing pieces of the second set of playing pieces.
Figure 4:
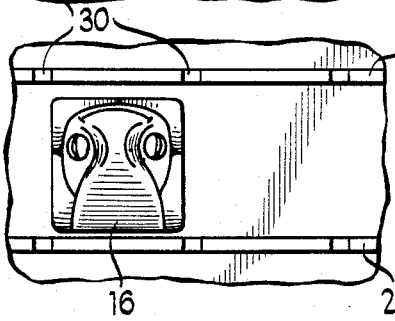
FIG. 4 is a partial, enlarged, top plan view of a portion of the embodiment shown in FIG. 1, particularly showing a playing piece of the first set of playing pieces.
Figure 5:
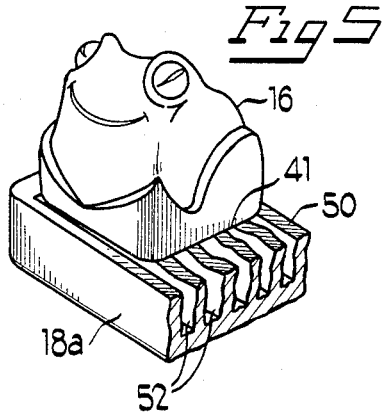
FIG. 5 is an enlarged, partial, perspective view showing a playing piece of the first set positioned atop a playing piece of the second set.
Figure 6:
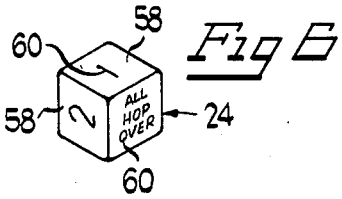
FIG. 6 is an enlarged, perspective view of a chance selection device useful in governing the movement of the various playing pieces in the embodiment shown in FIG. 1.

The playing pieces of the second set 18 move across the game board 12 in a direction generally transverse to the general direction of movement of the playing pieces of the first set 16 and specifically the second set 18 move along the lines joining the game board 10 edges 46 and 48. The log playing pieces 18*a* are located on playing positions 26 situated over the river indicia 38 while the car playing pieces 18*b* are situated on playing positions 26 located over the road indicia 32. Conveniently one car playing piece 18*b* is provided for those playing positions 26 located over each road indicia 32 while a log playing piece 18*a* is provided for each of the rows of playing positions 26 defined by adjacent members 28 over the river indicia 38. Conveniently both the playing pieces 18*a* and the playing pieces 18*b* are sized to simultaneously occupy two playing positions while the playing pieces of the first set of playing pieces 16 only occupy one playing position 26 at a time. As indicated in FIGS. 3 and 5 each log playing piece 18*a* has two opposing sides including a log side 50 bearing a plurality of wavy grooves 52 and a fly-side 54 bearing the indicia 56, conveniently in the form of a fly.

The chance selection device 24 includes a plurality of perpendicularly related sides 58 each bearing an indicia 60. In the illustrated embodiment, four of the sides 58 bear a numerical indicia indicating a number of movements to be undertaken by a playing piece 16 or 18 and two of the sides 58 include indicia 60 indicating a movement to be undertaken by a plurality of playing pieces 16 or 18. One of these two sides bears the "Turn Log" indicia signifying that one of the log playing pieces 18*a* should be turned over while the other of the two sides bears the "All Hop Over" indicia signifying that all playing pieces of the first set 16 that have been moved off of the swamp indicia 40 should be moved two playing positions 26.

The board game 10 is played by initially determining which of the players sold begin. In each turn a player rolls the chance selection device 24 and the upwardly facing indicia 60 determines the player's movement. If one of the numerical indicia 60 faces upwardly, the player has complete discretion in moving either one of his or her playing pieces of the first set 16 or moving any of the playing pieces of the second set 18.

The playing pieces of the first set 16 may be moved the number of playing positions 26 indicated by the numerical indicia 60 facing upwardly on the chance selection device 24 either in whole or in part. In other words the player may move one or more of the playing pieces 16 by the number of playing piece positions 26 indicated as long as the total number of positions moved does not exceed the number indiciated by the chance selection device 24. The playing pieces of the first set 16 may be moved sideways or forward but not diagonally or backward. Two or more playing pieces 16 cannot be positioned on the same playing position 26 at the same time. If a playing piece 16 does land on another playing piece 16, on either one of the player's own playing pieces 16 or one of the opponent's playing pieces 16, the moving player must move his or her playing piece 16 to the next playing position 26. The playing pieces 16 may jump over or land on the log playing pieces 18*a* rather than landing in playing positions 26 occupied by river indicia 38. When a playing piece 16 is on one of the playing pieces 18*a* it is considered safe and cannot be knocked off. If a playing piece 16 lands on a log playing piece 18*a* with its fly side 54 facing upwardly by exact count, the playing piece 16 is then moved two additional bonus spaces immediately. The game is complicated by the fact that a playing piece 16 cannot jump over or land on a car playing piece 18*b* and thus the car playing pieces 18*b* provide obstacles to the movement of the playing pieces 16 across the game board 12.

The log playing pieces 18*a* may be moved by any player in his or her turn and the player may use all or part of the moves alloted, to move log playing pieces 18*a*. A log playing piece 18*a* is moved along its row between a pair of members 28 and may never leave its assigned row. However one move of a log playing piece 18*a* entitles the player to position the log playing piece 18*a* anywhere along the length of the members 28. If an opponent's playing piece 16 is occupying a playing position 26 over the river indicia 38, and is not positioned on a log playing piece 18*a*, the player may use all or part of his or her alloted moves to slide a log playing piece 18*a* into the opponent's playing piece 16. The opponent then must return the playing piece 16 back to his or her swamp indicia 40 and begin the journey again. A player may also use all or part of his or her alloted moves to locate log playing pieces 18*a* to assist in crossing the river indicia 38. This is done by placing a log playing piece 18*a* with the fly-side 54 facing upwardly to receive a playing piece 16. Upon landing on the fly-side 54 of a log playing piece 18*a* the playing piece 16 is entitled to two bonus movements. In addition a player can move a log playing piece 18*a* that has a playing piece 16 located thereon and both the log playing piece 18*a* and playing 16 are moved as a result.

The car playing pieces 18*b* can also be moved by either player in turn. As with the other playing pieces 16 or 18 a player may use all or play of his or her alloted moves to move car playing pieces 18*b*. The numerical indication provided by the chance selection device 24, however, indicates how many car playing pieces 18*b* may be moved, not many spaces a car playing piece 18*b* may be moved. A car playing piece 18*b* may be moved by sliding it along its row to any position along the members 28 and this counts as one move. A car playing piece 18*b* may also jump from one row of playing positions 26 to another, counting as two moves, corresponding to a change in lane on a highway and the car playing piece 18*b* may be positioned on any playing position 26 in the new lane. A car playing piece 18*b* may be used offensively by moving a car playing piece 18*b* onto a position on the road indicia 32, occupied by an opponent's playing piece 16. With this happens the opponent must return his or her playing piece 16 to the player's swamp indicia 40. Alternatively the positioning of the car playing piece 18*b* may be used defensively by sliding the car playing piece 18*b* into a position right in front of an opponent's playing piece 16 so that the car playing piece 18*b* acts as a barricade to further movement by that particular playing piece 16.

Whenever a player operates the chance selection device 24 and the upwardly facing indicia 60 indicates that a long playing piece 18*a* must be turned, the player can flip any one of the log playing pieces 18*a* which the player desires. If the player receives the "all hop over" indication on the device 24 instead of a numerical indication, all of the playing pieces 16 are moved two spaces except those which have not yet left the swamp indicia 40.

The present invention is capable of implementing a highly entertaining board game which allows a player to utilize considerable strategy in moving his or her playing pieces 16 across the game board 12 and in slowing or preventing the opponent from doing the same thing. While the various indicia and the shape of the various playing pieces 16 and 18 in the illustrated embodiment is in keeping with the format of the well-known video game FROGGERS, a variety of other formats or themes may be utilized as well. However, it is believed that by using the FROGGERS format, a highly entertaining game is implemented which is capable of interaction and entertainment value that meets or exceeds that experienced in the playing of the FROGGERS video game.

While the present invention has been described with respect to a single preferred embodiment, those skilled in the art will appreciate a number of modifications therein, and it is intended to cover within the appended claims, all such modifications and variations that come within the true spirit and scope of the present invention.

What is claimed and desired to be covered by Letters Patent of the United States is:

1. A board game for two players comprising:

a game board having a generally planar playing surface with a plurality of playing positions;

said playing positions being arranged in a plurality of generally parallel rows and parallel columns, said rows being arranged generally perpendicularly to said columns;

a separate first set of playing pieces for each player positionable on said playing surface;

a common second set of playing pieces for both players positionable on and moveable over said playing surface within said rows;

said playing pieces of said second set including first and second groups of playing pieces, said first group of playing pieces having two distinct opposing sides, each of said sides providing a generally flat surface on which one of said playing pieces of said first set is positionable;

chance selection means for determining the extent of movement of said playing pieces; and said rows being defined by a plurality of parallel upstanding members, said members including column indicators spaced uniformly along their lengths.

2. The board game of claim 1 wherein said chance selection device includes a die, a plurality of the faces of said die bearing numerical indicia corresponding to a number of moves of said playing pieces and at least one of said sides bearing an indication corresponding to a movement of all of the playing pieces of the first set.

3. The board game of claim 1 wherein the playing pieces of said first set of each player include a forward face and are initially arranged on opposite sides of said game board and said playing pieces of said first set of each player are moveable in a counter flow arrangement across said game board.

4. The board game of claim 1 in which said second group of playing pieces has only a single generally flat surface so as to preclude positioning one of said playing pieces of said first set on a playing piece of said second group.

5. The board game of claim 1 wherein each of said rows is further defined by an indicia that is common to all of the positions within a particular row.

6. A board game for two players comprising:

a game board having a generally planar playing surface with a plurality of playing positions;

said playing positions being arranged in a plurality of generally parallel rows and parallel columns, said rows being arranged generally perpendicularly to said columns;

a separate first set of playing pieces for each player positionable on said playing surface;

a common second set of playing pieces for both players positionable on and moveable over said playing surface within said rows;

said playing pieces of said second set including first and second groups of playing pieces, said first group of playing pieces having two distinct opposing sides, each of said sides providing a generally flat surface on which one of said playing pieces of said first set is positionable;

chance selection means for determining the extent of movement of said playing pieces;

said playing pieces of said first set each occupying one position at a time and said playing pieces of said second set each occupying two positions at one time along one of said rows; and means restricting said playing pieces of said second set from occupying two positions at one time along any of said columns.

7. The board game of claim 6 wherein each of said positions along a first one of said rows has a first common indicia, each of said positions along a second one of said rows has a second common indicia, and each of said positions along a third one of said rows has a third common indicia.

8. The board game of claim 7 wherein said playing surface bears a plurality of distinct regions, each region comprising at least one of said rows, including a set of opposed regions near opposite sides of said game board bearing said first common indicia, an intermediate region bearing said second common indicia and a pair of regions between said intermediate region and said opposed regions bearing said third common indicia.

9. The board game of claim 6 wherein said chance selection device includes a die, a plurality of the faces of said die bearing numerical indicia corresponding to a number of moves of said playing pieces and at least one of said sides bearing an indication corresponding to a movement of all of the playing pieces of the first set.

10. The board game of claim 6 wherein the playing pieces of said first set of each player include a forward face and are initially arranged opposite sides of said game board and said playing pieces of said first set of each player are moveable in a counter flow arrangement across said game board.

11. The board game of claim 6 in which said second group of playing pieces has only a single generally flat surface so as to preclude positioning one of said playing pieces of said first set on a playing piece of said second group.

12. The board game of claim 6 wherein each of said rows is further defined by an indicia that is common to all of the positions within a particular row.

13. A board game for two players comprising:

a game board having a generally planar playing surface with a plurality of playing positions;

said playing positions being arranged in a plurality of generally parallel rows and parallel columns, said rows being arranged generally perpendicularly to said columns;

a separate first set of playing pieces for each player positionable on said playing surface;

a common second set of playing pieces for both players positionable on and moveable over said playing surface within said rows;

said playing pieces of said second set including first and second groups of playing pieces, said first group of playing pieces having two distinct opposing sides, each of said sides providing a generally flat surface on which one of said playing pieces of said first set is positionable;

chance selection means for determining the extent of movement of said playing pieces;

said rows being defined by a plurality of parallel upstanding members;

said members including column indicators spaced uniformly along their lengths;

said playing pieces of said first set each occupying one position at a time;

said playing pieces of said second set each occupying two positions at one time along one of said rows;

said members precluding a playing piece of said second set from occupying two positions at one time along a column; and said second group of playing pieces having only a single generally flat surface so as to preclude positioning a playing piece of said first set on a playing piece of said second group.

14. The board game of claim 13 wherein each of said rows is further defined by an indicia that is common to all of the positions within a particular row.

15. The board game of claim 13 wherein said chance selection device includes a die, a plurality of the faces of said die bearing numerical indicia corresponding to a number of moves of said playing pieces and at least one of said sides bearing an indication corresponding to a movement of all of the playing pieces of the first set.

16. The board game of claim 13 wherein the playing piece of said first set of each player include a forward face and are initially arranged on opposite sides of said game board and said playing pieces of said first set of each player are moveable in a conter flow arrangement across said game board.

17. The board game of claim 13 wherein each of said positions along a first one of said rows has a first common indicia, each of said positions along a second one of said rows has a second common indicia, and each of said positions along a third one of said rows has a third common indicia.

18. The board game of claim 17 wherein said playing surface bears a plurality of distinct regions, each region comprising at least one of said rows, including a set of opposed regions near opposite sides of said game board bearing said first common indicia, an intermediate region bearing said second common indicia and a pair of regions between said intermediate region and said opposed regions bearing said third common indicia.

* * * * *